US005131773A

United States Patent [19]

Gueret

[11] Patent Number: 5,131,773

[45] Date of Patent: Jul. 21, 1992

[54] PISTON DISPENSER FOR PASTE OR SOLID PRODUCTS INCLUDING A LINING OF ITS DISPENSING OPENING

[75] Inventor: Jean-Louis Gueret, Paris, France

[73] Assignee: L'Oreal, Paris, France

[21] Appl. No.: 737,848

[22] Filed: Jul. 30, 1991

Related U.S. Application Data

[63] Continuation of Ser. No. 474,407, Feb. 2, 1990, abandoned.

[30] Foreign Application Priority Data

Feb. 7, 1989 [FR] France ..... 89 01544

[51] Int. Cl.[5] ..... A45D 40/06; A45D 40/16

[52] U.S. Cl. ..... 401/68; 401/19; 401/22; 401/75; 401/174; 401/178

[58] Field of Search ..... 401/19, 22, 68, 75, 401/171, 172, 174, 178; 188

[56] References Cited

U.S. PATENT DOCUMENTS

| | | | |
|---|---|---|---|
| 1,720,369 | 7/1929 | McCue | 401/178 |
| 3,256,980 | 6/1966 | Bau | 401/174 X |
| 3,358,699 | 10/1962 | Bau . | |
| 3,825,021 | 7/1974 | Seidler | 401/188 X |
| 4,664,547 | 7/1985 | Rosenwinkel . | |

FOREIGN PATENT DOCUMENTS

| | | | |
|---|---|---|---|
| 782500 | 3/1935 | France | 401/19 |
| 1045189 | 11/1953 | France | 401/174 |
| 1193220 | 10/1959 | France . | |
| 1458448 | 10/1966 | France . | |
| 2228452 | 6/1974 | France . | |
| 2476020 | 8/1981 | France . | |
| 262675 | 7/1949 | Switzerland | 401/174 |
| 2144374 | 3/1985 | United Kingdom . | |
| 2150424 | 7/1985 | United Kingdom . | |
| 8601085 | 2/1986 | World Int. Prop. O. . | |

*Primary Examiner*—Steven A. Bratlie

*Attorney, Agent, or Firm*—Cushman, Darby & Cushman

[57] ABSTRACT

The dispenser of a solid or paste product to be spread includes a reservoir (1) containing the product (P), which is made available by a drive mechanism manually controlled by the user, the reservoir (1) being a tube the interior of which is cylindrical and of arbitrary cross section, the tube including a dispensing opening (4), and the product (P) being disposed in the tube between the dispensing opening (4) and a displaceable, slow-feed piston (5), the translation of the piston (5) being obtained by means of the drive mechanism, the drive mechanism including a rod (6) at the end of which the piston (5) is attached, the piston (5) being pierced, from its face (10) closest to the product (P) to its face facing elements of the drive mechanism, by at least one conduit (11). The edges of the dispensing opening (4) are at least partly lined with a layer of an air-permeable material that serves to apply the product (P), the layer (8) being positioned straddling the edges.

18 Claims, 2 Drawing Sheets

PISTON DISPENSER FOR PASTE OR SOLID PRODUCTS INCLUDING A LINING OF ITS DISPENSING OPENING

This is a continuation of application Ser. No. 07/474,407, filed on Feb. 2, 1990, now abandoned.

FIELD OF THE INVENTION

The present invention relates to a dispenser for a paste or solid product, such as a cosmetic product to be spread on the skin. In particular, this dispenser is of the type including a reservoir and a piston that is slowly translatable forward within the reservoir, for ejecting the product from it, by means of a manually controlled drive mechanism. The dispenser may also be suitably used for molded products such as lipstick, extruded products such as makeup base, or compacted products such as eyeshadow.

BACKGROUND OF THE INVENTION

Dispensers of this kind are already known and have been available to consumers for a long time. The piston that drives the product to be ejected translationally is generally mounted at the end of a threaded rod that cooperates with a nut integrally attached to the dispenser. The rod is in turn driven to rotate incrementally via a pushbutton actuated by the user (see French Patent 2 555 471, for example and French Patent Application 88-05026, filed Apr. 15, 1988).

When filling such a dispenser, the part of the dispenser including the drive mechanism is generally kept separate from the reservoir portion. This makes it possible to prevent improper handling during filling, which would make the dispenser unusable and hence unsaleable, since the portion including the drive mechanism has a relatively high production cost. Molding a product inside the reservoir presents no difficulty, since it suffices to close the reservoir with a bottom in order to form a container. However, extruding or compacting a product inside a container often does present problems of feasibility.

If one seeks to extrude a product into a container having a bottom by having the product substantially fit to the inside walls of the container, then when the product drops into the container the air between the container bottom and the product is trapped, and tends to stop the progress of the product toward the container bottom. Despite the several escape routes for the air that may exist through the interstices between the product and the walls of the container (these interstices form in the course of the filling operation and are deleterious to the appearance, as seen from the outside, of the product extruded into the reservoir), a layer of air still remains between the container bottom and the product. In the case where the container bottom corresponds to the piston surface facing the product, the action of the piston on the product is necessarily damped, and its reponse to manual actions by the user on the pushbutton is generally altered. In the case where the product is extruded via the portion of the reservoir opposite its dispensing opening—the piston having been put in place in the reservoir after the reservoir has been filled—and where the dispensing opening is associated with an element that plugs it, in order, along with the reservoir walls, to form a container, the layer of air will prevent the product from filling the reservoir up to the dispensing opening. An empty space of variable size will remain at the level of the dispensing opening, and before he can use the dispenser, the user will necessarily have to actuate the pushbutton several times, to make the product rise in the reservoir. Since the drive mechanism is a slow-feed mechanism, this is somewhat disadvantageous to the salability of the dispenser.

If the product is one that must be compacted inside the reservoir, essentially the same problems are encountered. When the product is compacted by compressing it with a piston onto the bottom of the container, some means of evacuating the air must be provided. If the air is allowed to pass between the walls of the container and the peripheral walls of the compressor piston, then the product is not compacted well at its edges, that is, the surface where it has not been compressed. Contrarily, if the piston is correctly dimensioned, then escape routes for the air must be provided in the container bottom, because the presence of a cushion of air prevents proper compacting of the powder in the vicinity of the cushion, as noted in French patent application 88-02457, filed on Feb. 29, 1988.

SUMMARY OF THE INVENTION

The present invention proposes a device making it possible to overcome these disadvantages. In particular, it proposes a dispenser including a reservoir that is filled by its end opposite its dispensing opening. The edges of this dispensing opening are provided with an air-permeable material and are encased in a bore provided in a support the bottom of which, along with the reservoir walls, forms a container. When a product is to be extruded into or compacted in this container, via the end of the reservoir opposite the dispensing opening, the air driven back by the product or by the compressor piston in the bottom of the container escapes as the filling proceeds, through the layer of air-permeable material that surrounds the edges of the reservoir. This layer thus serves as a vent, and it makes it equally possible to mold, compact or extrude a product, all with the same device comprising a reservoir encased in a support. A device according to the invention also makes exact positioning of the product at the level of the dispensing opening possible.

Additionally, this single layer of air-permeable material has numerous other advantages. In particular, it makes it possible to hide the shrinkage that often occurs as cosmetic products age because of the tendency of their edges to pull away from the container walls. This layer can also serve as an applicator pad with which the product can be spread, and which can prevent the product from soiling the outside of the reservoir. Finally, for a product intended to be spread on the skin, this layer has the advantage of making for gentler contact between the skin and the dispenser.

Hence the subject of the invention is a dispenser of a solid or paste product to be spread which is contained in a reservoir and is made available by a drive mechanism manually controlled by the user, the reservoir being a tube having a cylindrical interior and an arbitrary cross section; the tube includes a dispensing opening, and a product is disposed in the tube between the dispensing opening and a displaceable, slowfeed piston. The translation of the piston is obtained by means of the drive mechanism, which includes a rod at the end of which the piston is attached, and the edges of the dispensing opening are at least partially lined with a layer that serves to apply the product and is made of an air-permeable material, the layer being positioned straddling the edges. This material may be porous and spongy. This application layer may be a flock or a synthetic foam with open or closed pores. If it is a flock, then it may be glued or deposited electrostatically onto the edges of the dispensing opening.

Advantageously, the piston is pierced, from its face closest to the product to its face facing elements of the drive mechanism, by at least one conduit. This conduit may be located in the axial extension of the rod. The piston and the rod may be two separate pieces, the head of the rod pressing on a surface of the piston into which the conduit opens in order to push the piston translationally. The end of the rod head may have a center punch with a substantially conically shaped free end, the surface of the piston with which it cooperates having a conical shape corresponding to that of the end of the center punch. The surface of the substantially conically shaped piston may be extended via a guide bore. In the vicinity of its end that is attached to the rod, the center punch may include a plate perpendicular to the axis of the rod.

Preferably, the peripheral wall of the piston is provided with at least one annular lip in contact, with slight squeezing, with the inner wall of the the reservoir. The piston may include at least one annular lip toward each of its end faces. In an advantageous embodiment, the edge of the dispensing opening is disposed obliquely with respect to the axis of the reservoir. The reservoir may be nested inside a tubular joining piece with which it is associated, its outer wall and the inner wall of the joining piece each being provided with a helical ramp, the helical ramps cooperating to keep the reservoir in a predetermined angular position with respect to the joining piece. The reservoir may be detachable with respect to the drive mechanism, and the rod can be disengaged from the drive mechanism at the moment when the reservoir is attached to the drive mechanism. The rod may be a screw driven in rotation by the drive mechanism and cooperating with a nut that is fixed with respect to the joining piece, and the nut is slit along a generatrix; the end of the reservoir opposite the dispensing opening of the reservoir is nested onto the outer walls of the nut by conical seating.

The subject of the invention will be better understood from the ensuing purely illustrative, non-limiting description of an exemplary embodiment, shown in the accompanying drawings.

DESCRIPTION OF THE PREFERRED EMBODIMENT

Figure 1:
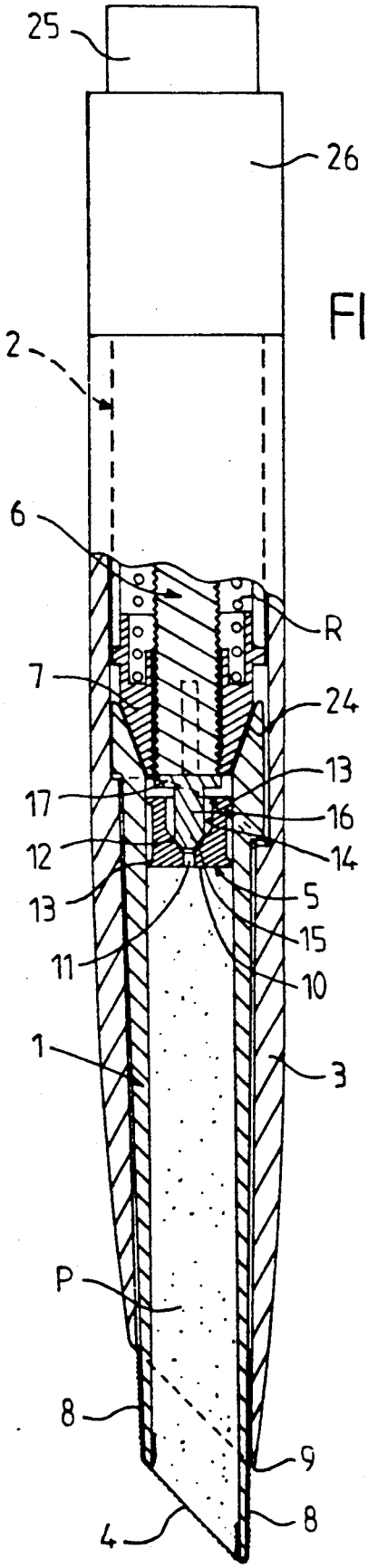
FIG. 1 is an elevation view, partly in section and cut away, of a dispenser according to the invention.

Turning to the drawing, the dispenser is seen to include a reservoir 1 mounted on a part 2 that includes the drive mechanism of the dispenser. These two parts of the dispenser are nested together and kept in place in a tubular joining piece 3 that forms a sheath comprising the body of the dispenser. By screwing or interlocking, the sheath 3 is fixed to a shoulder 26 that is solidly attached to the drive mechanism.

The reservoir 1 is a tube, the interior of which, intended to contain a product P comprising a paste or a compacted powder, is a straight cylinder of right circular cross section. One of its ends is a dispensing opening 4. The piston 5 is threaded on toward its other end, coming in contact with the product P and cooperating with the end of a screw 6. The thread of this screw 6 cooperates with the thread of a nut 7 of the drive mechanism 2 in order to drive the piston 5 translationally along the axis of the reservoir 1. The dispensing opening 4 of the reservoir 1 is oblique with respect to the axis of the reservoir, with an inclination of 60° with respect to a plane orthogonal to the axis of the reservoir. The outer face of the wall of the reservoir 1 is slightly frustoconical. This outer wall fits together with the inner wall of the tubular joining piece or sheath 3, in which it is nested; part of the reservoir 1, toward the dispensing opening 4, projects from the sheath 3. The end 9 of the sheath 3 closest to the opening 4 is also oblique with respect to the axis of the reservoir 1 and is parallel to the plane in which the opening 4 is located. The wall of the sheath 3 thickens, beginning at the end 9 and extending to approximately the middle of the reservoir 1.

The edges of the dispensing opening 4 are coated with a layer of flock 8. This layer of flock 8 is positioned straddling the edges of the opening 4, and the surface area of the flock 8 on the inside of the reservoir 1 is less than that of the flock on the outside of the reservoir 1. The thickness of this layer of flock 8 is less than 30% of the thickness of the edge of the dispensing opening 4. The end of the flock 8 farthest from the opening 4, on the outer surface of the reservoir 1, is positioned on a circle in a plane orthogonal to the axis of the reservoir 1. To prevent contamination of the product, the flocking is provided before the reservoir is filled, by depositing fibers on the walls of the reservoir electrostatically or with glue. To obtain precise flocking inside the reservoir 1, a mandrel (not shown) that is threaded on the inside and substantially fits to its inner wall may be used. The end of this mandrel closer to the opening 4 is offset slightly in the reservoir 1 from the edges of the opening 4, such that the flock 8 can be deposited on the inner wall of the reservoir 1; the surface area deposited is defined perfectly by the level of the mandrel. In a variant, the flock may be replaced with a synthetic foam, for example expanded "in situ".

The piston 5 is an element of revolution. One of its faces is a plate 10 in contact with the product P. This plate 10 is pierced by an axially centered conduit 11 prolonged in the piston 5 past the plate 10 by a conical recess 12 made in the body of the piston 5. The conical recess 12 is in turn prolonged axially by a bore 14, which discharges at the other face of the piston 5. Each of the end faces of the piston 5 is surrounded on its periphery by an annular lip 13 intended to be in contact, with slight squeezing, with the inner wall of the reservoir 1. The head of the screw 6 has a center punch 16, one conical end 15 of which is intended to cooperate with the conical recess 12 of the piston 5. The center punch !6 is a cylindrical body, the diameter of which is slightly less than that of the bore 14; it nests in place by sliding inside the bore 14. At its end opposite the conical portion 15, the center punch 16 includes a plate 17, which is a disk resting on the rod 6; this disk has a diameter larger than the diameters of the rod 6 and the cylindrical body of the center punch 16.

The nut 7 is a slit nut, including three sectors 18 distributed symmetrically about the axis of the nut 7. These three sectors 18 are connected to one another at one of their ends by a cylindrical skirt 20 that extends their peripheral walls. Their ends opposite this skirt 20 form the frustoconical head of the nut, which is axially pierced by a bore 19 having substantially the same diameter as the screw 6 which is disposed inside it. The bore 1 is threaded at its end opposite the skirt 20. Its thread 21 is intended for cooperation with the thread of the screw 6. On its end opposite the dispensing opening 4, the inside wall of the reservoir 1 is provided with a bearing 24 shaped frustoconically to adapt to the head of the nut 7. The sheath 3 of the distributor and the reservoir 1 are each provided with a helical ramp 22, 23 toward the end of the reservoir 1 opposite the dispensing opening 4; the ramp 22 is disposed on the outer wall of the reservoir 1 and the ramp 23 on the inner wall of the sheath 3. Each of these two ramps 22 and 23 comprises a setback from the wall on which each of the ramps is disposed. As a result, at the level of the ramp 22, the wall of the reservoir 1 is thinner on the side toward the dispensing opening 4 than on the other side toward the ramp 22. The wall of the sheath 3 is thicker at the level of the ramp 23 in its part closer to the open end 9 than on the other side with respect to the ramp 23. These two ramps 22 and 23 are intended to cooperate and they enable the angular positioning of the reservoir i and sheath 3 such that their openings 4 and 9 are parallel. In the assembled position, the reservoir 1 rests with its frustoconical bearing 24 on the sectors 18 comprising the head of the nut 7, and its ramps 22 rests on the ramp 23 of the sheath. The fixation of the sheath 3 on the shoulder 26 thus makes it possible to maintain the reservoir 1 in position and to maintain its action on the nut 7 in order to close the sectors 18 around the screw 6.

The reservoir 1, sheath 3, piston 3 and nut 7 are parts that are molded from plastic material. After these various pieces have been made, in a first period of time, the filling of the reservoir 1 is accomplished and, separately, the assembly of the parts of the portion 2 including the drive mechanism is done. Such a drive mechanism may of the type described in French Patent Application 88.05026 of the present applicant; in particular, it includes a spring R and a pushbutton 25 mounted on the end of the shoulder 26 located farthest from the reservoir 1; depressing the pushbutton 25 makes it possible to control the translation of the piston 5, and the spring R assures the return of the pushbutton. During a second period of time, the reservoir 1 is mounted on the portion 2 that includes the drive mechanism, by nesting the assembly in the sheath 3. The end of the drive device opposite the nut 7 is solidly attached to the shoulder 26, onto which the end of the sheath 3 is fixed. This shoulder 26 is screwed onto an internal thread 27 with which the corresponding end of the sheath 3 is provided. In one possible variant, the fixation is done by latching.

Figure 2:
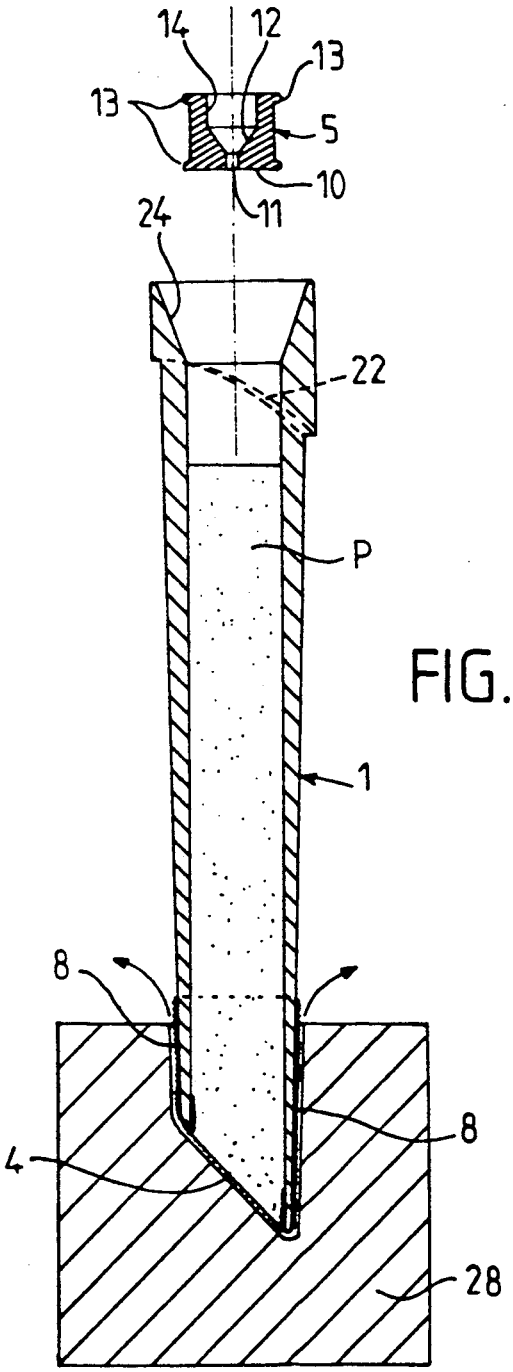
FIG. 2 is a sectional view of the reservoir and piston of the dispenser of FIG. 1, the reservoir being fitted in a support, in the position for filling.
Figure 3:
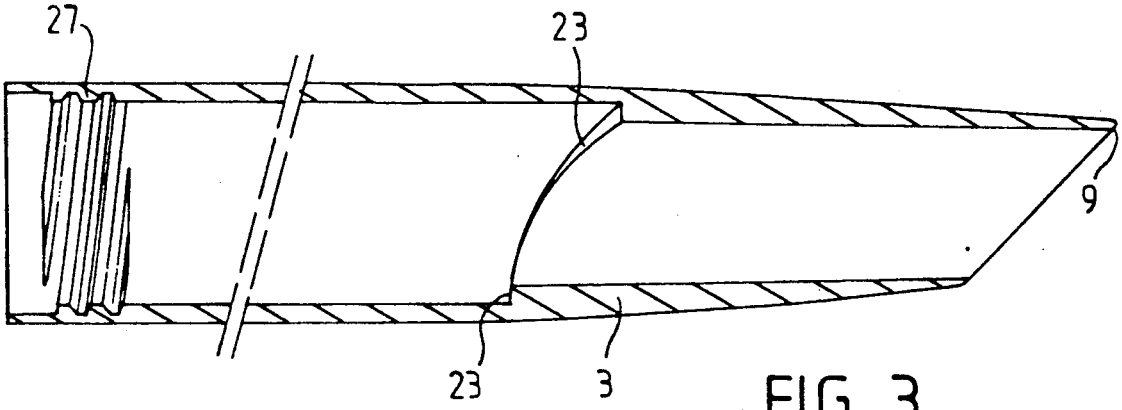
FIG. 3 is a sectional view of the tubular joining piece of the dispenser of FIG. 1.
Figure 4:
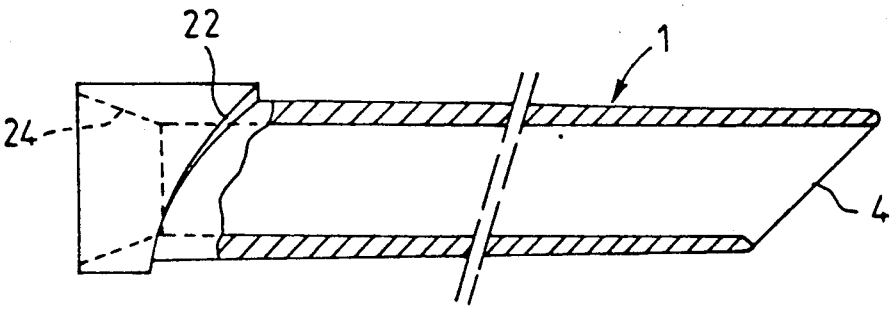
FIG. 4 is an elevation view, partly in section and cut away, of an unfilled reservoir intended for the dispenser of FIG. 1.
Figure 5:
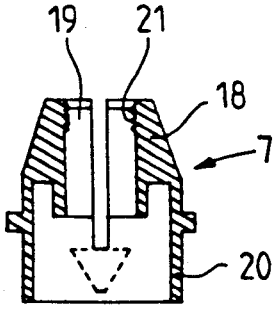
FIG. 5 is a sectional view along the line V—V of FIG. 6 of the nut of the dispenser of FIG. 1.
Figure 6:
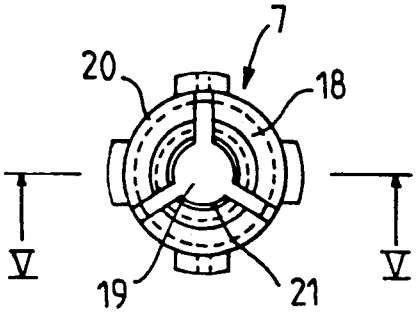
FIG. 6 is an end view of the nut of the dispenser of FIG. 1.

For either molding, extruding or compacting a product in the reservoir, the device of FIG. 2 is used to fill the reservoir 1. The reservoir 1 is held vertically in a bore made in a support 28; the dispensing opening 4 is encased in this bore, and the conical bearing 24 opens upward. The bottom of the bore of the support 28 is an inclined plane on which the edges of the dispensing opening 4 rest. Its side wall fits against the flock 8 and squeezes it against the edges of the dispensing opening 4. The reservoir 1 and the support 28 thus together form a container having a bottom and capable of holding liquid or solid substances, and in which a product such as lipstick can be molded. If it is desired to extrude or compact a product here, then the product P is introduced via the end of the reservoir 1 opposite the dispensing opening 4, and for the compacting the product is compressed by threading a compressor piston into the interior of the reservoir. In both cases, the air driven back toward the bottom of the container is evacuated as a result of the flock 8, which is air-permeable, as the arrows in FIG. 2 indicate. Thus the product P can be emplaced without any flaw at the opening 4.

Next, on the end opposite the dispensing opening 4, the piston 5 is threaded on, with its plate 10 being directly face-to-face with the product P. The piston 5 slides in the interior cylinder of the reservoir 1 until its plate 10 is in contact with the product P, regardless of the level to which the product P has been filled in the reservoir; the air located between the plate 10 and the product P escapes via the conduit 11. Next, the screw 6 is positioned such that the conical portion 15 of its center punch 16 is fitted into the conical recess 12 of the piston 5, after having been guided in the cylindrical bore 14. Finally, the assembly formed by the shoulder 26 and the portion 2 of the dispenser, which includes the drive mechanism, is fastened by threaded the screw 6 into the bore 19 until the sectors 18 forming the conical head of the nut 7 rest on the frustoconical bearing 24 of the reservoir 1, thus closing the thread 21 of the bore 19 again on the thread of the screw 6. Once the assembly has been put in place, it remains to nest the reservoir 1 and the portion 2 into the sheath 3 and to assure the fixation of the sheath 3 on the shoulder 26.

The assembly is now finished and ready to be used. By actuating the pushbutton 25, the user releases a fine layer of product P from the reservoir 1, which is applied to the desired region by spreading it onto the layer of flock 8, which thus serves as an applicator pad and presents the product P from soiling the edges of the reservoir 1. If the product P is furthermore a cosmetic product intended to be applied to the skin, then the layer of flock 8 has the further advantage of making the contact between the skin and the dispenser more gentle. Once it has been spread, the product P is located substantially just below the rounded end of the flock 8 at the edges of the dispensing opening 4, but above the end of the wall of the reservoir 1. A stopper (not shown) making it possible to prevent the product P from drying out or deteriorating can also be associated with the dispensing opening 4.

Finally, in the case where the sheath has been screwed onto the shoulder 26, then when the product P in the reservoir 1 has been used up completely and is to be replaced, the shoulder 26 can be unscrewed and the portion 2 including the drive mechanism can be disengaged from the sheath 3. The sectors 18 of the nut 7 are no longer in contact with the bearing 24 of the reservoir 1, and the thread 21 of the bore 19 no longer cooperates with the thread of the screw 6, so that the screw can be made to slide freely in the bore 19, while the plate 17 of the head of the screw 6 nevertheless comprises a travel limitation. Hence it is possible to replace a reservoir 1 that has been more or less used up with a different reservoir 1. Such an arrangement thus makes it possible to use a plurality of reservoirs 1 as refills, with the same portion 2 serving as a drive mechanism.

What is claimed is:

1. A dispenser for a product to be spread comprising:

a reservoir for the product, said reservoir comprising a tube having a cylindrical interior of a substantially constant diameter, one end of said tube having a dispensing opening of said substantially constant diameter;

a piston movably disposed in said cylindrical interior; and a drive means for dispensing the product from said reservoir, said drive means including a rod having one end engageable with said piston for moving said piston in said cylindrical interior of said tube upon actuation of said drive means, said dispensing opening having an edge and surfaces surrounding said edge with a layer of air-permeable material covering said edge and at least part of said surrounding surfaces, the thickness of said layer being less than 30% of the thickness of said edge of said opening.

2. A dispenser as defined by claim 1, characterized in that the material of the layer serving to apply the product is porous and spongy.

3. A dispenser as defined by one of claims 1 or 2, characterized in that the layer is a flock with pores.

4. A dispenser as defined by one of claims 1 or 2, characterized in that the layer is a synthetic foam with pores.

5. A dispenser as defined by claim 3, characterized in that the layer is a flock glued onto the edge of the dispensing opening.

6. A dispenser as defined by claim 3 characterized in that the layer is deposited electrostatically onto the edge of the dispensing opening.

7. A dispenser as defined by one of claims 1 or 2, characterized in that the piston is pierced, from its face closest to the product (P) to its face facing elements of the drive mechanism, by at least one conduit (11).

8. A dispenser as defined by claim 7, characterized in that the conduit is oriented to be coaxial with the rod.

9. A dispenser as defined by claim 5, characterized in that the piston and the rod are two separate pieces with the head of the rod pressing on a surface of the piston in order to push the piston translationally.

10. A dispenser as defined by claim 9, characterized in that the end of the head of the rod has a center punch, the free end of which is shaped substantially conically, and that the surface of the piston with which it cooperates has a conical shape corresponding to that of the end of the center punch (16).

11. A dispenser as defined by claim 10, characterized in that the surface of the substantially conically shaped piston is extended with a guide bore.

12. A dispenser as defined by 10, characterized in that the center punch in the vicinity of its end that is attached to the rod, includes a plate perpendicular to the axis of the rod.

13. A dispenser as defined by 12, characterized in that the peripheral wall of the piston is provided with at least one annular lip that is in contact, with slight squeezing, with the inner wall of the said reservoir.

14. A dispenser as defined by claim 13, characterized in that the piston includes at least one annular lip toward each of its end faces.

15. A dispenser as defined by 1, characterized in that the edge of the dispensing opening is disposed obliquely with respect to the axis of the reservoir.

16. A dispenser as defined by claim 1 characterized in that the reservoir is nested inside a tubular joining piece with which it is associated, its outer wall and the inner wall of the joining piece each being provided with a helical ramp, said helical ramps cooperating to keep said reservoir in a predetermined angular position with respect to said joining piece.

17. A dispenser as defined by claim 1, characterized in that the reservoir is detachable with respect to the drive mechanism, and that the rod can be disengaged from the drive mechanism at the moment when the reservoir is attached to said drive mechanism.

18. A dispenser as defined by claim 1, wherein the reservoir is nested inside a tubular joining piece with which it is associated, the rod being a screw driven in rotation by the drive means and cooperating with a nut that is fixed with respect to the joining piece, the nut being split along a generatrix, the end of the reservoir opposite the dispensing opening of said reservoir being nested onto the outer walls of the nut by conical seating.

* * * * *